US005841943A

United States Patent [19]

Nosenchuck

[11] Patent Number: 5,841,943

[45] Date of Patent: Nov. 24, 1998

[54] DUCTED FLOW HAIR DRYER WITH MULTIPLE IMPELLERS

[75] Inventor: Daniel M. Nosenchuck, Mercerville, N.J.

[73] Assignee: SounDesign, LLC, Mercerville, N.J.

[21] Appl. No.: 845,399

[22] Filed: Apr. 25, 1997

[51] Int. Cl.[6] ..... A45D 20/10; F24H 3/00

[52] U.S. Cl. ..... 392/385; 34/97

[58] Field of Search ..... 392/385, 383–384, 392/382, 379; 34/96, 97

[56] References Cited

U.S. PATENT DOCUMENTS

| | | | |
|---|---|---|---|
| 1,564,896 | 12/1925 | Rinker et al. . | |
| 1,821,525 | 10/1931 | Nielsen . | |
| 2,432,067 | 12/1947 | Morse . | |
| 2,713,627 | 7/1955 | Kamataris | 392/383 |
| 3,211,890 | 10/1965 | Graves . | |
| 3,284,611 | 11/1966 | Laing . | |
| 3,905,379 | 9/1975 | Churas et al. | 132/9 |
| 3,939,850 | 2/1976 | Wahl | 132/11 |
| 3,943,329 | 3/1976 | Hlavac . | |
| 3,981,314 | 9/1976 | Barradas | 132/9 |
| 4,135,080 | 1/1979 | Wells, Jr. . | |
| 4,232,454 | 11/1980 | Springer | 34/97 |
| 4,593,179 | 6/1986 | Schultz et al. . | |
| 4,596,921 | 6/1986 | Hersh et al. . | |
| 4,678,410 | 7/1987 | Kullen | 417/423 |
| 5,054,211 | 10/1991 | Shulman | 34/97 |
| 5,161,317 | 11/1992 | McDougall | 34/97 |
| 5,317,815 | 6/1994 | Hwang | 34/97 |
| 5,341,578 | 8/1994 | Anderson | 34/97 |
| 5,392,528 | 2/1995 | McDougall | 34/97 |
| 5,471,763 | 12/1995 | McArthur | 34/96 |

FOREIGN PATENT DOCUMENTS

| | | | |
|---|---|---|---|
| 2435925 | 4/1980 | France | 392/384 |
| 2529816 | 1/1977 | Germany . | |
| 2529817 | 1/1977 | Germany . | |
| 4105583 | 8/1992 | Germany . | |
| 4429112 | 1/1995 | Germany . | |
| 60-135700 | 7/1985 | Japan . | |
| 61-31696 | 2/1986 | Japan . | |
| 2-218308 | 8/1990 | Japan . | |
| 3-82402 | 4/1991 | Japan . | |
| 1433465 | 10/1988 | U.S.S.R. . | |
| 1467642 | 3/1977 | United Kingdom . | |
| 1519652 | 8/1978 | United Kingdom . | |

*Primary Examiner*—John A. Jeffery
*Attorney, Agent, or Firm*—David M. Quinlan, PC

[57] ABSTRACT

An axial flow hair dryer comprises a main housing and an outer duct secured to the main housing with the axis of the outer duct coincident with the axis of the main housing and with the axial air outlet of the main housing disposed within the outer duct to form an annular air intake between the main housing and the outer duct. A first fan stage and first stator stage are disposed within the main housing and a second fan stage and second stator stage are disposed within the outer duct. A handle depending from the main housing holds a motor that is mounted using vibration-absorbing material to inhibit the propagation of noise generated by the motor. A flexible shaft connects the motor to a drive shaft that carries both fan stages. Resistance heating wires are wrapped around the vanes of the first stator stage to heat the air flowing through the hair dryer.

23 Claims, 4 Drawing Sheets

DUCTED FLOW HAIR DRYER WITH MULTIPLE IMPELLERS

BACKGROUND OF THE INVENTION

1. Field of the Invention

The present invention relates to a hair dryer, and more particularly, to a hand-held, ducted, axial-flow hair dryer.

2. Description of Related Art

There are myriad different approaches to providing hair dryers for consumer use. The primary consideration for such hair dryers is that they provide a flow heated of heated air in a sufficient quantity to evaporate water from the user's hair.

That goal is typically realized using a blower that directs air over a heating device, such as a resistance coil, and then to an outlet. Both axial-flow and centrifugal blowers have been used in known hair dryers. See, for example, U.S. Pat. No. 4,678,410 and German Patent DT 25 29 817, which disclose hair dryers using axial-flow impellers, and U.S. Pat. No. 3,943,329 and British Patent No. 1,519,652, which disclose hair dryers using centrifugal-flow impellers.

Hand-held hair dryers have been in general use for many years, and have found wide acceptance in the consumer market. As the market has matured, commercial success has demanded an increased ability to perform the hair dryer's main task, that is, drying hair, while providing a device that is quiet and safe to use.

To increase drying ability, one approach that will obviously work is simply to increase the heat of the air expelled from the unit. This approach has the drawback of increasing the possibility of burns to the user. There have been some attempts to ameliorate this shortcoming by providing ducting around the dryer outlet to inject ambient air into the exit air stream. See, for example, U.S. Pat. No. 3,284,611. U.S. Pat. No. 3,943,329 also discloses ducting provided around the hair dryer outlet for safety reasons. Hair dryers with this type of passive ducting do not have a significantly increased amount of fluid flow for drying a user's hair.

Therefore, to the extent that the use of such ducting reduces the risk of injury to the user, it also reduces the effectiveness of the exit air in drying the user's hair. That is, it reduces the temperature of the air directed against the user's hair without significantly increasing the amount of air available to perform drying.

A ducting arrangement is also shown in U.S. Pat. No. 5,317,815, in which a separate shell is attached to the outlet of a hair dryer. The shell contains an impeller vane that is rotated by the exit air from the hair dryer, and is said to induce ambient air into the flow through holes in the rear of the housing. Since the outlet of the shell is larger than the hair dryer outlet, the cross-sectional area of the air stream is increased. However, those familiar with the principles of fluid mechanics and the laws of physics will realize that driving the impeller vane with the exit air from the hair dryer imparts no additional energy to the air stream. Therefore, while it may marginally increase the amount of air flow, the increase is not significant enough to offset the loss in drying effectiveness caused by reducing the air temperature through entraining ambient air in the flow.

Clearly, the amount of air flow can be increased simply by increasing the speed of the rotating blower. That, however, increases the amount of noise generated by the hair dryer. According to well known principles, so-called "dipole noise," $N_{db}$, caused by rotating components satisfies the relationship:

$$N_{db} \propto \omega^6 \quad (1)$$

From equation (1) it can seen that dipole noise is proportional to the sixth power of the rotational speed $\omega$ of the flow-generating components of a hair dryer. Therefore, very small increases or decreases in the rotational speed $\omega$ will have a great effect on the dipole noise generated by a hair dryer. Jet noise, generated by the air stream mixing with the ambient air at the dryer exit, also contributes to the noise perceived by the hair dryer user.

At the relatively low air flow velocities in a hair dryer, dipole noise is the predominant noise source.

However, since jet noise scales with air flow velocity to the eighth power (that is, $U^8$), jet noise can be reduced perceptibly by reducing the velocity of the air stream exiting the hair dryer. On the other hand, it is likewise important that the drying ability of the hair dryer not be compromised by reducing the air flow velocity.

It has been recognized that hair dryer dipole noise can be reduced by using an axial-flow impeller, with rotor and stator elements. See, for example, U.S. Pat. No. 4,678,410. And even a multi-stage axial-flow impeller, with successive rotor and stator stages, has been used. See, for example, German Patent No. DT 25 29 817.

However, those arrangements are used essentially to provide air flow like that provided by more widely used centrifugal blowers. They can produce the same air flow at a lower rotational speed of the blower, but they do not represent a different approach to solving the problems inherent with hair dryers using centrifugal blowers. That is, they can only produce significantly greater air mass flow by increasing rotational speed, and they can increase drying effectiveness only by increasing the heater (and therefore air) temperature.

What is required to move to the next generation hair dryer is a configuration that will provide optimum air mass flow and permit reduced air flow velocities, and also enable the efficient introduction of an appropriate amount of heat, while reducing noise levels to the barest minimum.

BRIEF DESCRIPTION OF THE INVENTION

It is an object of the invention to achieve those goals by overcoming the limitations inherent in previous hair dryer configurations and approaches.

According to one aspect of the present invention, an axial flow hair dryer comprises a housing forming an air flow passage having an air inlet and an air outlet, a first axial flow impeller disposed in the housing for generating air flow from the inlet to the outlet of the housing, an outer duct having an air inlet and an air outlet, the outer duct being secured to the housing with the air outlet of the housing disposed to form an annular air intake between the housing and the outer duct, a second axial flow impeller disposed in the outer duct for generating air flow through the annular air intake to the outlet of the outer duct, driving means for supplying motive force to the first axial flow impeller and second axial flow impeller, and heating means for heating the air flowing through the hair dryer.

In its more detailed aspects, an axial flow hair dryer in accordance with the present invention comprises a housing forming an air flow passage having an axis and an air inlet and an air outlet, which housing includes a handle depending therefrom, an integrally molded first fan stage including a first axial flow impeller disposed in the housing for generating air flow from the inlet to the outlet of the housing generally along the axis thereof, an integrally molded first stator stage disposed in the housing downstream of the first fan stage and having a plurality of radially extending, flat stator vanes connected to a hub at the axis of the housing and rigidly secured to said housing, an outer duct forming an air flow passage having an axis substantially coincident with the axis of the housing and having an air inlet and an air outlet, the outer duct being rigidly secured to the housing with the air outlet of the housing disposed within the outer duct to form an annular air intake between the housing and the outer duct, an integrally molded second fan stage including a second axial flow impeller disposed in the outer duct for generating air flow through the annular air intake to the outlet of the outer duct, the second axial flow impeller including a plurality of inner blades and a plurality of outer blades separated by an annular shroud that forms an extension of the air flow passage formed by the housing, an integrally molded second stator stage disposed in the outer duct downstream of the second fan stage and including a plurality of radially extending, flat inner vanes connected to a hub at the axis of the outer duct and to an annular shroud that forms an extension of the extended air flow passage formed by the annular shroud of the second fan stage and a plurality of radially extending, flat outer vanes connected to the annular shroud, wherein the outer vanes are rigidly secured to the outer duct, a motor mounted inside the handle with a vibration-absorbing material interposed between the motor and the handle, a drive shaft mounted for rotation in the hub of the first stator stage and the hub of the second stator stage, the first fan stage and the second stator stage being mounted to the drive shaft for rotation therewith, a flex shaft for supplying motive force from the motor to the drive shaft, and resistance heating means for heating air flowing through the air dryer.

BRIEF DESCRIPTION OF THE DRAWINGS

The objects of the invention will be better understood from the detailed description of its preferred embodiments which follows below, when taken in conjunction with the accompanying drawings, in which like numerals refer to like features throughout. The following is a brief identification of the drawing figures used in the accompanying detailed description.

FIGS. 4A and 4B together present a detailed view of the first fan stage 100 of the hair dryer depicted in FIG. 2, wherein FIG. 4A is a perspective view and FIG. 4B is a front view of the first fan stage.

FIG. 5A and 5B together present a detailed view of the first stator stage 150 of the hair dryer depicted in FIG. 2, wherein FIG. 5A is a front view of the first stator stage and FIG. 5B is a sectional view taken along line 5B—5B of FIGURE 5A.

FIG. 6A and 6B together present a detailed view of the second fan stage 20 of the hair dryer depicted in FIG. 2, wherein FIG. 6A is a perspective view and FIG. 6B is a rear view of the second fan stage.

FIGS. 7A and 7B together present a detailed view of the second stator stage 250 of the hair dryer depicted in FIG. 2, wherein FIG. 7A is a rear view of the second stator stage and FIG. 7B is a sectional view taken along line 7B—7B of FIG. 7A.

DETAILED DESCRIPTION OF PREFERRED EMBODIMENTS

Figure 1:
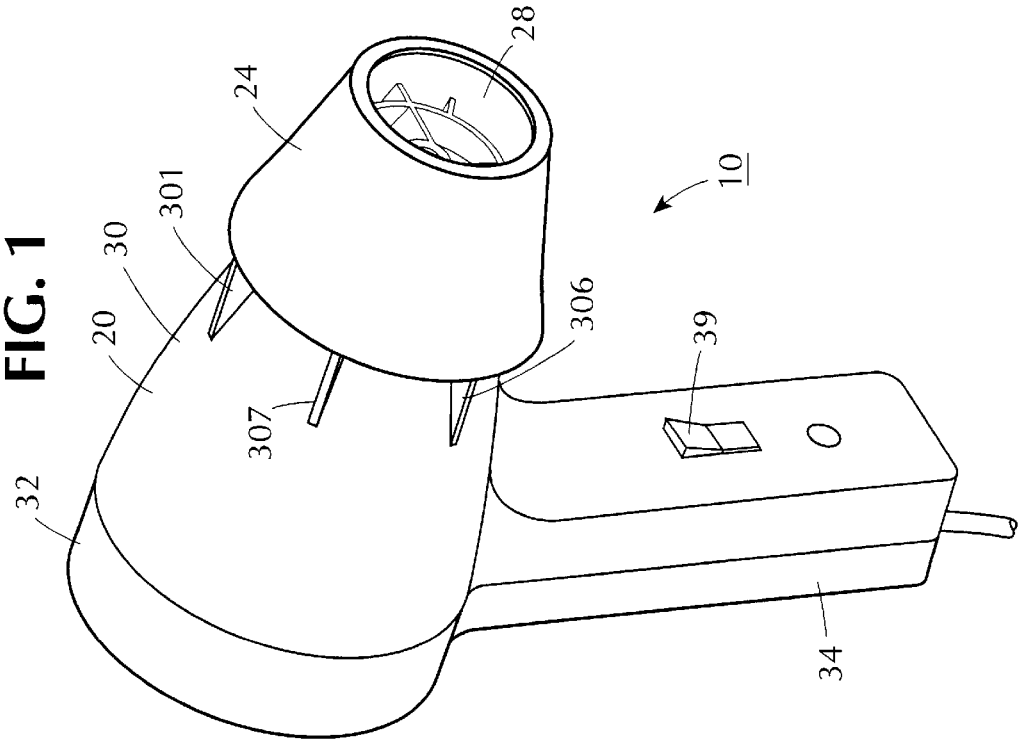
FIG. 1 is an overall depiction of a preferred embodiment of a hair dryer comprising the present invention.
Figure 2:
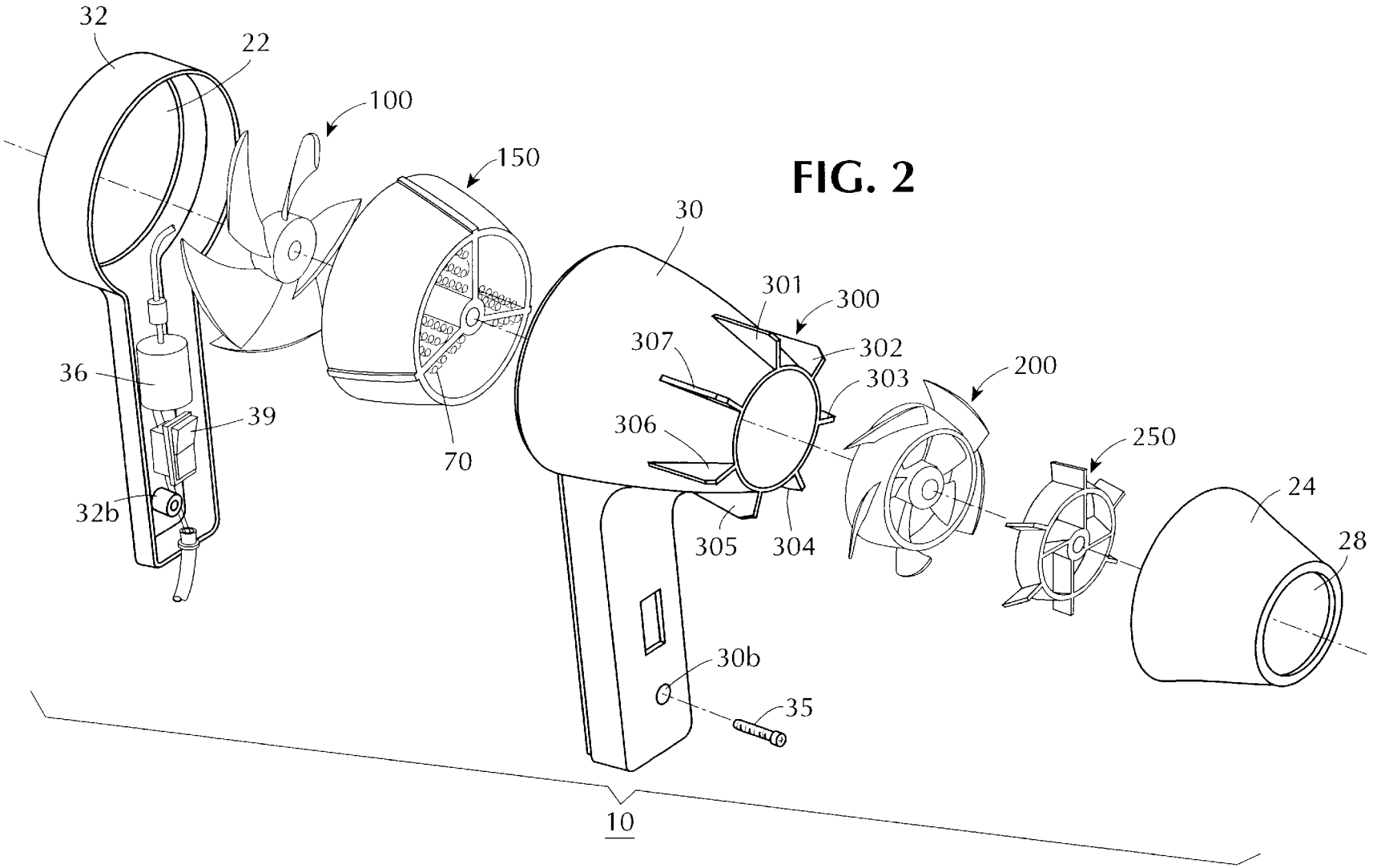
FIG. 2 is an exploded perspective view of the hair dryer shown in FIG. 1.
Figure 3:
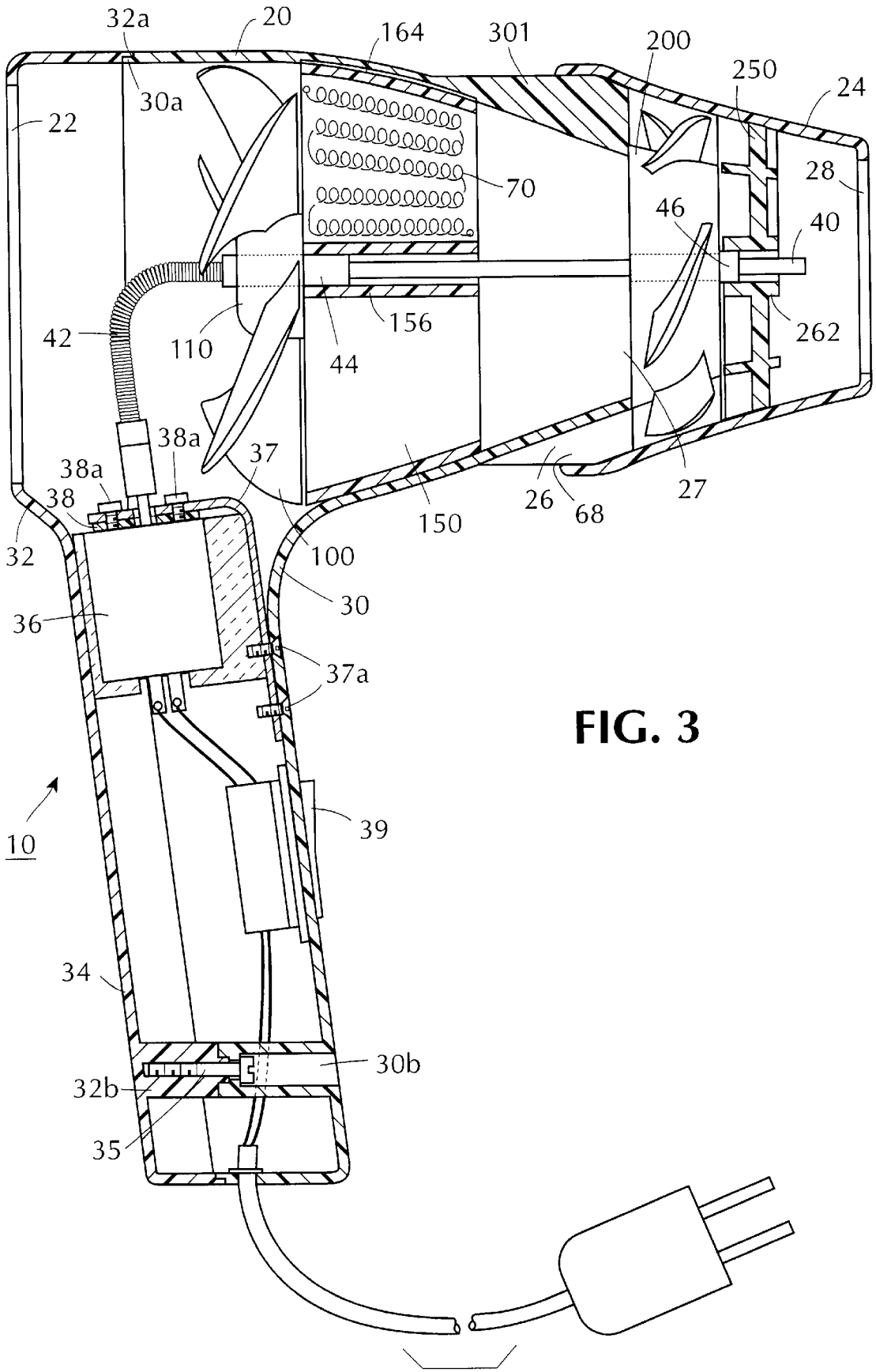
FIG. 3 is a cross-sectional view taken along the axis of the hair dryer depicted in FIG. 1.

Referring to FIGS. 1 to 3, a hair dryer 10 according to an embodiment of the invention includes a main housing 20 with an air inlet 22. The hair dryer 10 also includes an outer air duct 24 that overlaps a portion of the main housing 20 to form an annular air intake 26 between the outside of the main housing 20 and the inside of the outer duct 24. That is, in the present embodiment the outlet 27 of the main housing 20 is disposed within the outer duct 24. The outer duct 24 terminates in an air outlet 28. The main housing 20 and outer duct 24 incorporate an axial-flow impeller system described in more detail below.

The main housing 20 is provided in two parts, a forward housing 30 and a rear cover 32. Both the forward housing 30 and rear housing 32 are integral units injection molded of plastic, and they mate as shown in FIGS. 1 and 3 to form the main housing 20 and a hollow handle 34 depending integrally from the main housing 20.

FIG. 3 illustrates how the forward housing 30 and rear cover 32 mate to form the main housing 20 and the integral handle 34 depending from the main housing 20. The forward housing 30 has a thinned portion forming a flange 30*a* around its open rear face, and the rear cover 32 has a undercut portion 32*a* inside the periphery of its open front face. The undercut portion 32*a* fits over the external flange 30*a* on the forward housing 30, and the rear cover 32 and forward housing 30 are secured together by a screw 35 passed through a counterbore 30*b* on the handle portion of the forward housing 30 and threaded into a boss 32*b* on the handle portion of the rear cover 32.

The cooperating flange 30*a* and undercut portion 32*a* positively locate the forward housing 30 and rear cover 32 relative to each other. The screw 35 removably secures the forward housing and rear cover together. The flange 30*a* and undercut portion 32*a* permit the forward housing 30 and rear cover 32 to be secured together with their outer surfaces flush with each other.

A motor 36 is disposed in the handle 34. This is an important feature of the present invention, because it allows the motor to be isolated acoustically from the remaining structure of the hair dryer. In the embodiment illustrated in FIG. 3 the motor 36 is mounted to a motor bracket 37 made of suitable sheet metal bent into the shape depicted. The motor bracket is secured to the handle portion 34 of the forward housing 30 using countersunk screws 37*a* threaded into the bracket 37. Alternatively, the screws could be threaded into lock nuts on the other side of the bracket 37. The motor 36 is secured to the bracket 37 with a shock absorber 38 interposed between the bracket 37 and the motor 36. The shock absorber 38 can be an appropriate rubber compound or any other suitable vibration-absorbing material. Bolts 38*a* pass through the bracket 37 and are threaded into the motor housing to hold the motor onto the bracket 37 with the shock absorber 38 sandwiched between them. Of course, an alternative fastening technique can also be used, as mentioned above in connection with the screws 37*a*. Instead of using a bracket which is isolated from the motor 36 by a shock absorber, it would also be possible to mount the motor by enveloping it completely in a vibration-absorbing material such as polyurethane foam capable of holding the motor in place.

As discussed in more detail below, the unique fluid flow properties of a hair dryer according to the present invention make it feasible to employ an axial-flow impeller system with the drive motor off-axis. Therefore, the noise reduction made possible by the fluid flow properties of the hair dryer can be enhanced further still by placing the motor in a location where a suitable mounting arrangement, such as one of those discussed above, can be employed to isolate the user from the noise and vibration inherent in operation of the motor.

The handle 34 also contains conventional circuitry for supplying power to the motor 36 as well as to resistive heating elements, discussed in detail below. An ON-OFF switch 39 is conveniently placed on the handle. This switch can be a toggle switch as shown, or a slide switch, or assume other forms, but in any case it will typically have multiple positions corresponding to multiple power settings (that is, blower speed/heating current combinations) for providing maximum convenience of use to the operator. The circuitry required for providing multiple power settings to that end will be conventional in design and within the skill of those working in this field. Accordingly, a detailed description of same is not included here.

The multi-stage, ducted, axial-flow structure of the hair dryer of the present invention includes multiple fan and stator stages in the ducts formed by the main housing 20 and outer air duct 24. These stages are the first fan stage 100, the first stator stage 150, the second fan stage 200, the second stator stage 250 and a duct stator stage 300. The fan stages 100 and 200 are mounted to an axial drive shaft 40 that is supported for rotation by the stator stages 150 and 250 in a manner discussed in detail below. A flex shaft 42 constitutes a drive mechanism that provides motive power to the drive shaft 40 from the motor 36.

FIG. 2 shows the duct stator stage 300 in detail. It comprises seven vanes 301, 302, 303, 304, 305, 306 and 307, molded integrally with the forward housing 30. As FIG. 3 illustrates, the large-diameter inlet end of the outer duct 24 fits over the vanes 301–307 and is suitably secured thereto to mount the outer duct on the forward housing. The outer duct 24 is a plastic, injection-molded, one-piece part. It is secured to the vanes 301–307 by heat welding or with an adhesive or both. Of course, other materials and attachment techniques can be used.

Figure 4A:
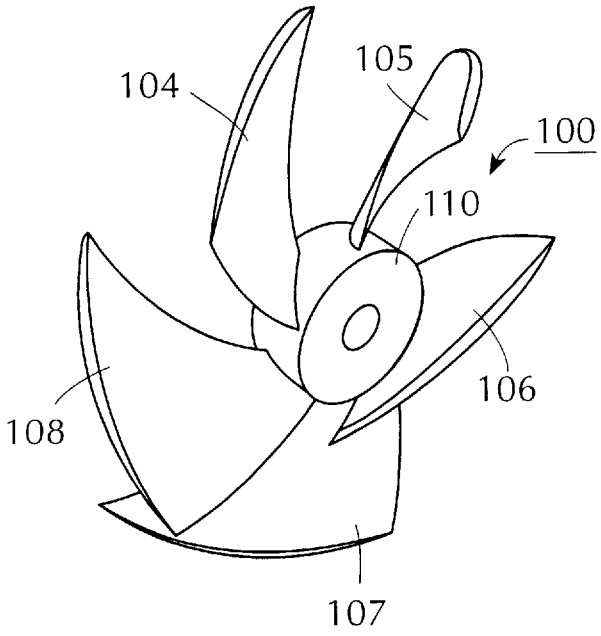
Figure 4B:
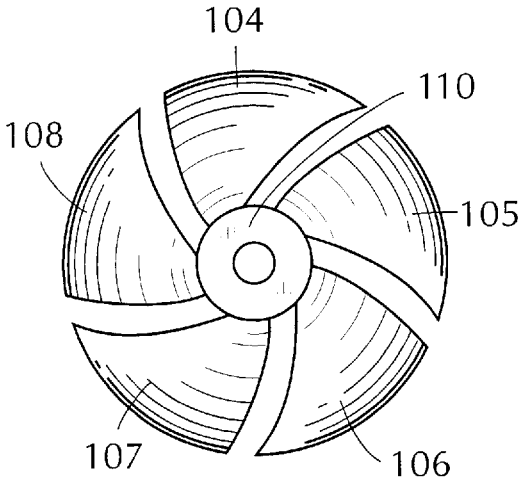

FIGS. 4A and 4B show the first fan stage 100 in detail. The first fan stage comprises an axial flow impeller having five blades 104, 105, 106, 107 and 108 attached to a hub 110. The fan blades 104–108 have the shape shown in FIG. 4A and 4B. The first fan stage may also conveniently be an injection-molded, one-piece, plastic part.

Figure 5B:
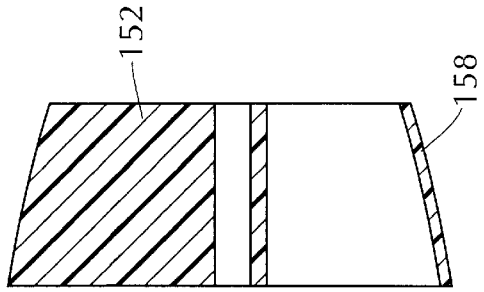

The first stator stage 150, shown in detail in FIGS. 4A and 5B, is located just downstream of the first fan stage 100. The first stator stage includes three vanes 152, 153 and 154. The vanes 152–154 extend radially between a hub 156 and an outer envelope 158. The entire first stator stage 150 is integrally molded from a suitable material. The contour of the outer envelope 158 generally matches the contour of the forward housing 30 of the main housing 20. The outer envelope 158 includes axially extending ridges 160, 161 and 162 that fit into cooperating axial grooves 164 (see FIG. 3) in the forward housing 30 to positively locate the first stator stage angularly in the forward housing 30.

Such a locating system is preferred because the forward housing 30 is not completely symmetrical about its axis at the location where the first stator stage is mounted. That is, the inclusion of the handle 34 as part of the main housing causes the bottom portion of the main housing to be non-cylindrical where it smoothly transitions into the portion comprising the handle. As a result, the outer envelope 158 does not contact the inner surface of the housing 30 around the envelope's entire periphery.

Accordingly, the two vanes 153 and 154 are spaced 150° apart, symmetrical about a diameter of the stator 150 that includes the first vane 152. In that manner, the vanes 152–154, all of which serve the structural purpose of supporting the dryer's drive shaft in a manner discussed below, are positively supported by the housing 30.

Figure 6A:
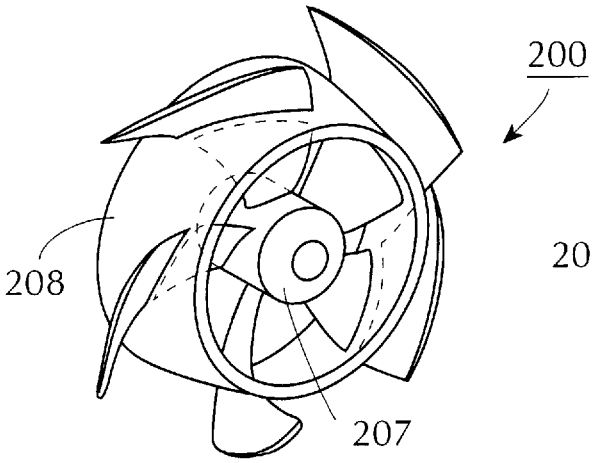
Figure 6B:
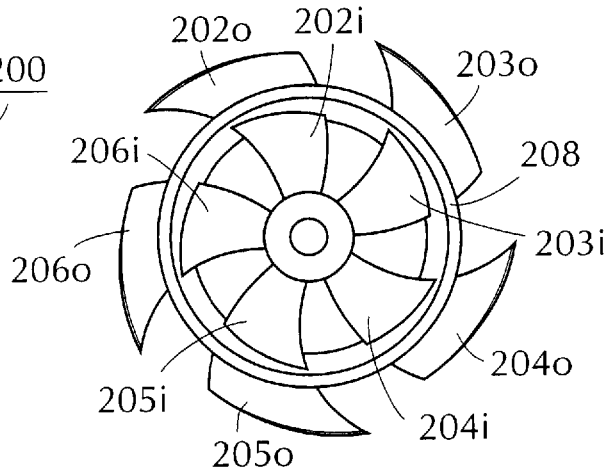

FIGS. 6A and 6B show the second fan stage 200, which is provided just beyond the end of the housing 30. The second fan stage includes five evenly spaced inner blades 202*i*, 203*i*, 204*i*, 205*i* and 206*i* extending outwardly from a hub 207, and five evenly spaced outer blades 202*o*, 203*o*, 204*o*, 205*o* and 206*o*, each of which extends outwardly as a continuation of the corresponding inner blade of the same number. Separating the inner and outer rotor blades is an annular shroud 208 that forms an extension of the housing 30. That is, except for the axial clearance between the end of the housing 30 and the shroud 208, the latter forms a part of the inner air duct provided by the forward housing 30. The second fan stage 200 is injection molded in one piece using plastic.

Figure 7B:
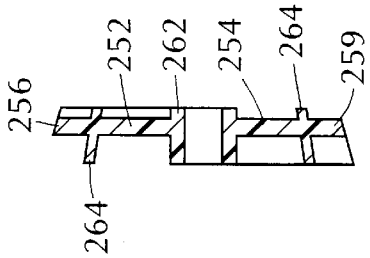
Figure 5A:
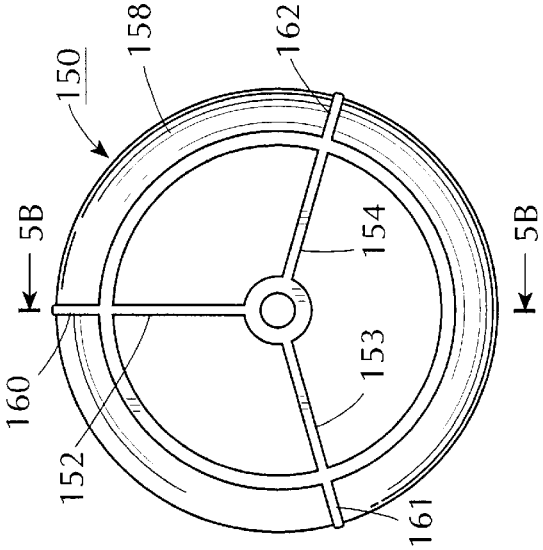
Figure 7A:
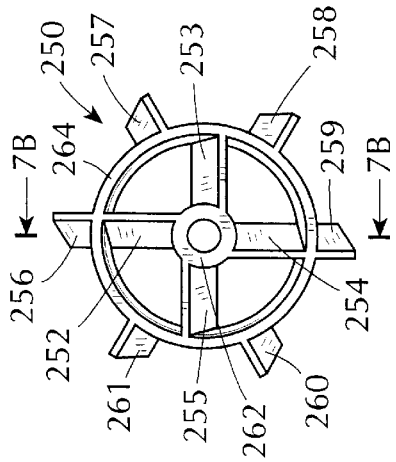

FIGS. 7A and 7B show the second stator stage 250. It comprises four evenly spaced inner vanes 252, 253, 254 and 255, and six evenly spaced outer vanes 256, 257, 258, 259, 260 and 261. The inner vanes 256–261 extend between a central hub 262 and terminate at an annular shroud 264 which forms an extension of the annular shroud 208 of the second fan stage 200. The outer vanes 256–261 extend radially outwardly from the shroud 264. It is integrally molded by injection molding.

The hair dryer of the present invention is typically assembled in the following manner. The outer envelope 158 of the first stator stage 150 is introduced into the forward housing 30 through its open rear face. The axial ridges 160–162 are positioned for insertion into the cooperating grooves in the inner surface of the forward housing 30. The outer envelope 158 is secured to the inner surface of the forward housing in any suitable manner, preferably by heat welding and using an adhesive. It is important that the first stator stage 150 be firmly attached to the forward housing 30, because the hub 156 forms the rear bearing for supporting the axial drive shaft 40 of the hair dryer.

Prior to assembling the first stator stage into the front housing, the vanes 152–154 are each wrapped with resistance heating coils 70 of Nichrome® alloy wires, as shown in FIG. 3. These wires are connected in a suitable fashion to the power circuitry in the handle 34 once the first stator stage 150 is assembled into the forward housing 30.

The second stator stage 250 is securely attached within the outer duct 24 by heat welding and/or using an adhesive to firmly secure the outer vanes 256–261 to the inside wall of the outer duct at the proper axial location. Again, it is important that the second stator stage be securely and rigidly attached to the outer duct so that a rigid structure is formed, because the hub 262 provides a bearing for the drive shaft 40 in a manner to be described.

The drive shaft 40, onto which the hub 207 of the second fan stage 200 has been secured in a suitable fashion, is inserted through the hub 156 of the first stator stage 150 and held in place while the outer duct is positioned on the vanes 301–307 forming the duct stator stage.

The end of the drive shaft 40 is introduced through the central opening in the hub 262 of the second stator stage and the outer duct is secured to the vanes 301–307 by heat welding and/or using an adhesive. In this manner, the two stator stages 150 and 250, the forward housing 30 and the outer duct 24 form a rigid, permanent assembly supporting the drive shaft 40 for rotation in the hubs 156 and 262.

The hubs each include a suitable bearing surface, such as a bronze insert or a coating of Teflon® polymer, to reduce friction on the shaft 40 and the bearing surface. Cooperating sleeves 44 and 46 of Teflon® polymer also may be used. If so, they are secured rigidly to the drive shaft and the respective hubs 110 and 207 of the first and second fan stages, so that rotational motive force applied to the drive shaft causes rotation of the fan stages. The drive shaft is also secured against axial movement in a suitable manner, such as by ring clips (not shown) fitting in circumferential grooves in the shaft.

The first fan stage is then secured to an end of the drive shaft 40 extending beyond the first stator stage 150. The flex shaft 42 is secured in a suitable manner between the motor 36 and the drive shaft 40, and the rear cover 32 is attached to the front housing to complete the hair dryer 10.

It may be noted that the second stator stage 250 can be used to provide additional heat capacity by wrapping some or all of the stator vanes with resistive heating coils in the same manner as the vanes 152–154 of the first stator stage are wrapped with Nichrome® alloy wires (see FIG. 3). In that event, the second stator stage is made from a suitable material, and the wires are connected to the power circuitry in an appropriate fashion to provide operation as desired. For example, at maximum air flow all heating coils on both stator stages could be activated to provide maximum drying ability. Suitable combinations of air mass-flow and heat input can be developed by those skilled in the art without a more detailed description here.

The air intake 22 at the rear cover 32 and the air outlet 28 at the end of the outer duct 24 may require suitable protection. This will typically be provided in the form of having the air inlet formed of radially extending slots (not shown) too small for the passage of the user's fingers, or a metal screen, or both. The same will be true of the air outlet. These safety features are largely governed by industry standards, and the hair dryer of the present invention can easily accommodate any such safety requirements.

An advantage of the present invention is that the air flow characteristics of the hair dryer can be tailored to maximize mass flow of the dryer's air throughput while minimizing the speed of revolution of its rotating parts. The use of multiple rotor stages and providing the annular air intake 26 significantly increases the mass flow rate of air through the hair dryer at a given rotational speed. For example, commercial hair dryers today typically run at speeds of about 10,000 rpm, and sometimes even higher. The present invention can duplicate the same mass flow rate at rotational speeds in the order of one-half of that of current commercial hair dryers.

The mathematical techniques for providing the desired flow characteristics of a hair dryer with the configuration shown are well known to those skilled in the art. The shape of the housing 20 and outer duct 24, the axial length of the annular duct 68 between them and the variation in area of that annular duct in the axial direction, the number of stator and rotor stages, and the shapes and number of blades in each, are all capable of being chosen by those skilled in the art using known principles of aerodynamics and fluid mechanics.

An example of how the configuration of the various parts can be determined will be given for illustrative purposes. It should be understood that other configurations are possible within the scope of the invention.

A typical starting point will be the rotating speed $\omega$ of the drive shaft 40 and thus of the two fan stages 100 and 200. It may be desired to minimize the noise generated by the hair dryer by choosing $\omega_{max.}$=5000 rpm (revolutions per minute). The heat output is expressed as follows:

$$\dot{q}=\dot{m}C_p\Delta\bar{T} \quad (2)$$

where $\dot{q}$ is the heat output of the dryer, $\dot{m}$ is the mass flow of air through the dryer, $C_p$ is the heat capacity of air, and $\Delta\bar{T}$ is the temperature increase over ambient of the air exiting the hair dryer. $C_p$ is a known property of air, and the maximum exit temperature of the air is set by industry standards as embodied in specifications published by Underwriters Laboratories, Inc. A typical maximum heat output $\dot{q}$ might be 2000 watts, which using equation (2) yields a required air mass flow $\dot{m}$=0.03 $m^3$/sec for an exit temperature of about 70° C.

Using known equations for axial-flow fan design, the configuration of each fan stage can be determined. Of course, that presupposes that the number of fan stages has been chosen. In the embodiment of the invention shown herein, a hair dryer with two fan stages is depicted. To avoid complications, certain design choices can also be incorporated into the fan stages. For example, the blades can be made essentially flat (that is, with minimum camber). It is important to realize that the first and second fan stages must be designed in concert. For example, it has been found that the blade incidence-angle in the second fan stage generally should be greater than the blade incidence-angle in the first fan stage. An ideal configuration will yield a uniform velocity profile in the radial direction at any given axial location in the air dryer.

As for the stator stages, they are provided by flat vanes in the present embodiment, although the invention is not limited to the use of flat stator vanes. As is well known, the stators straighten, or "deswirl," the flow exiting the fans, to recover the kinetic energy in the flow. That is, after exiting a fan stage, the air flow has a complex velocity distribution that detracts from its kinetic energy in the axial direction. The stator stages redirect the flow to recover this kinetic energy. The vanes 301–307 of the duct stator stage 300 help to direct the flow into the outer blades **202*o*–206*o*** of the second fan stage at an optimum angle of attack.

The air flow envelope of the ducts is also chosen according to known engineering design principles. The exit velocity of the air flow is an important parameter in that regard. Those skilled in the art will recognize that there are certain practical limits that consumers place on exit velocity magnitudes, as well as there being engineering reasons to have an exit velocity of a certain minimum value.

However, once the total mass flow through the hair dryer is determined, the required dimensions of the ducts can be determined knowing the desired exit velocity. In the embodiment depicted herein, the main housing 30 has a cylindrical inlet portion that extends to the downstream end of the first fan stage 100. Then, the flow envelope is a cubic function, that is, $d=f(x^{1/3})$, where d is the diameter of the main housing and x is the axial distance along the housing. The outer duct 24 is also configured as a cubic function of the axial distance along the duct. This profile is chosen empirically to inhibit flow separation from the internal duct walls.

It is preferable that the number of stator vanes in each stage be different from the number of fan blades. If the number were equal, there would be a periodic situation in which the ducts are subject to minimum blockage (when the fan blades are in the same angular position as the stator vanes), and maximum blockage (when the fan blades are equally spaced angularly between the stator vanes). This effect is experienced by the user as a source of periodic noise. Using unequal numbers of stator vanes and fan blades minimizes this effect. It should also be mentioned that the present invention is not limited to the use of a particular number of fan blades or stator vanes in a particular stage, or to the number of fan and stator stages shown.

As noted above, the air flowing through the hair dryer is heated by resistance coils 70 wound around the vanes 152–154 of the first stator stage 150. The resistance coils 70 are in an actuation circuit that permits them to be energized for different levels of heat generation. For example, the resistance coils 70 are energized to a lower temperature to provide a low-heat setting in which the air is heated to a moderate temperature, and to a higher temperature to provide a high-heat setting. In the low-heat setting the fans are rotated at a low speed and in the high-heat setting they are rotated at a higher speed.

Wrapping the resistance coils around the stator vanes provides some unique advantages. It causes intimate contact between the air flow and the heating coils because the heating coils induce turbulence in the flow and thus increase mixing of the air flow passing over the vanes, thereby promoting more efficient heat transfer from the coils to the air. At the same time, the resistance coils do not significantly decrease the flow area and they do not have a deleterious effect on the operation of the stator vanes in deswirling the flow. This enhanced mixing effect enables the heating coils to be concentrated in a smaller area in the flow stream, thus reducing the pressure drop across the heating coils.

It is not necessary to coil the wires before they are wrapped around the stator vanes. For example, the wires can be made of a flat cross-section and wound around the stator vanes in a fashion similar to that shown for the coiled wires depicted herein. Such an arrangement also serves to "trip" the flow over the vanes, thus inducing turbulence and enhancing mixing. This arrangement makes the air flow through the hair dryer more efficient because it will reduce even further the pressure drop caused by having the coils in the air flow.

If desired, however, one or more additional resistance coils can be placed in the path of the flow. One way of introducing an additional heating coil would be to provide a grid in the main housing 20 downstream of the first stator stage 150. This grid could be rigidly attached to the housing to increase its structural rigidity.

An important feature of the present invention is the placement of the motor 36 in the handle 34. In any hair dryer, the motor contributes to the total noise generated when operating the hair dryer. In the present invention, the motor 30 is placed in the handle where it can be isolated from the structure of the hair dryer, as discussed above, thus reducing the overall noise generated by the hair dryer. In prior axial flow air dryers, the motor typically forms a part of the rotor axis, as in U.S. Pat. No. 4,678,410 and German Patent No. DT 25 29 817. This reduces the space available for air flow and makes noise shielding more difficult.

In the present invention, the use of ducted, axial air flow with multiple rotor stages reduces the rotational speed and torque that the motor must deliver.

Therefore, the motor can be located remotely in relation to the rotor axis and a drive train mechanism used to transient motive power to the rotor axis.

In the embodiment shown, the drive train comprises the flex shaft 42. This flex shaft is a double-wound spring, which has good resistance to torsional deformation but low bending resistance. Those skilled in the art will recognize that this flex shaft will have a natural frequency of vibration depending on its physical properties, such as Young's modulus and cross-sectional area. However, because of the lowered rotational speeds of the hair dryer of the present invention, it is possible to provide a flex shaft with a natural frequency much higher than the maximum rotational speed it will encounter in operation. Accordingly, the motor 36 can be placed in the handle 34 and acoustically isolated from its mounting structure.

It will be appreciated that other drive train arrangements can be substituted for that described above. For example, the fan stages need not be mounted on the same drive shaft or rotate at the same speed or direction. Moreover, a transmission mechanism other than the flex shaft 42, such as a belt-and-pulley system, can be used.

While preferred embodiments of the invention have been depicted and described, it will be understood that various modifications and changes can be made other than those specifically mentioned above without departing from the spirit and scope of the invention, which is defined solely by the claims that follow.

What is claimed is:

1. An axial flow hair dryer comprising:

a housing forming an air flow passage between an air inlet for ambient air and an air outlet;

a first axial flow impeller disposed in said housing for generating an ambient air flow into said air flow passage through said housing air inlet;

an outer duct having an air inlet and an air outlet, said outer duct being secured to said housing with said housing air outlet disposed to introduce air flow exiting said housing air outlet into said outer duct and to form an air intake for ambient air between said housing and said outer duct;

a second axial flow impeller disposed in said outer duct for generating an ambient air flow into said outer duct through said air intake annularly of said air flow exiting said housing air outlet;

driving means for supplying motive force to said first axial flow impeller and second axial flow impeller; and heating means for heating air flowing through said hair dryer and exiting said outer duct air outlet.

2. An axial flow hair dryer as in claim 1, wherein said first axial flow impeller and said second axial flow impeller are mounted on a single drive shaft.

3. An axial flow hair dryer as in claim 2, wherein said drive means comprises an electric motor connected to said drive shaft by a transmission mechanism.

4. An axial flow hair dryer as in claim 3, wherein said housing includes a handle depending from said housing and said motor is disposed in said handle.

5. An axial flow hair dryer as in claim 4, wherein said transmission mechanism comprises a flexible drive member.

6. An axial flow hair dryer as in claim 5, wherein said flexible drive shaft comprises a spring.

7. An axial flow hair dryer as in claim 4, further comprising sound insulating material substantially surrounding said motor.

8. An axial flow hair dryer as in claim 2, further comprising:

a first stator stage disposed in said housing downstream of said first axial flow impeller; and a second stator stage disposed in said outer duct downstream of said second axial flow-impeller.

9. An axial flow hair dryer as in claim 2, wherein said drive means comprises a motive power source connected to said drive shaft by a transmission mechanism.

10. An axial flow hair dryer as in claim 9, wherein said transmission mechanism comprises a flexible drive shaft.

11. An axial flow hair dryer as in claim 2, further comprising a stator stage disposed in said housing downstream of said first axial flow impeller.

12. An axial flow hair dryer as in claim 2, further comprising a stator stage disposed in said outer duct downstream of said second axial flow impeller.

13. An axial flow hair dryer as in claim 1, wherein said air intake comprises an annular passage between said housing and said outer duct.

14. An axial flow hair dryer comprising:

a housing forming an air flow passage having an axis and an air inlet and an air outlet, said housing including a handle depending therefrom;

an integrally molded first fan stage including a first axial flow impeller disposed in said housing for generating air flow from said inlet to said outlet of said housing generally along the axis thereof;

an integrally molded first stator stage disposed in said housing downstream of said first fan stage and having a plurality of radially extending, flat stator vanes connected to a hub at said axis of said housing and rigidly secured to said housing;

an outer duct forming an air flow passage having an axis substantially coincident with said axis of said housing and having an air inlet and an air outlet, said outer duct being rigidly secured to said housing with said air outlet of said housing disposed within said outer duct to form an annular air duct between said housing and said outer duct;

an integrally molded second fan stage including a second axial flow impeller disposed in said outer duct for generating air flow through said annular air duct to said outlet of said outer duct, said second axial flow impeller including a plurality of inner blades and a plurality of outer blades separated by an annular shroud that forms an extension of said air flow passage formed by said housing;

an integrally molded second stator stage disposed in said outer duct downstream of said second fan stage and including a plurality of radially extending, flat inner vanes connected to a hub at said axis of said outer duct and to an annular shroud that forms an extension of said extended air flow passage formed by said annular shroud of said second fan stage and a plurality of radially extending, flat outer vanes connected to said annular shroud, wherein said outer vanes are rigidly secured to said outer duct;

a motor mounted inside said handle with a vibration-absorbing material interposed between said motor and said handle;

a drive shaft mounted for rotation in said hub of said first stator stage and said hub of said second stator stage, said first fan stage and said second stator stage being mounted to said drive shaft for rotation therewith;

a flex shaft for supplying motive force from said motor to said drive shaft; and resistance heating means for heating air flowing through said air dryer.

15. An axial flow hair dryer as in claim 14, wherein said housing includes a forward housing having said first stator stage secured therein and a rear housing having said air inlet therein said forward housing including a plurality of flat stator vanes extending radially outward proximate to said air outlet to which stator vanes said outer duct is rigidly secured.

16. An axial flow hair dryer as in claim 15, wherein said flex shaft is a spring.

17. An axial flow hair dryer as in claim 16, wherein said motor is secured to a bracket having a rubber shock absorber between said bracket and said motor and said bracket is secured to said forward housing.

18. An axial flow hair dryer as in claim 15, wherein said resistance heating means includes a wire coil disposed in said housing.

19. An axial flow hair dryer comprising:

a housing forming an air flow passage having an air inlet and an air outlet;

a first axial flow impeller mounted on a drive shaft and disposed in said housing for generating air flow from said inlet to said outlet of said housing;

a first stator stage disposed in said housing downstream of said first axial flow impeller;

an outer duct forming an air flow passage having an air inlet and an air outlet, said outer duct being secured to said housing with said air outlet of said housing disposed to form an annular air intake between said housing and said outer duct;

a second axial flow impeller mounted on said drive shaft and disposed in said outer duct for generating air flow through said annular air intake to said outlet of said outer duct, wherein said second axial flow impeller includes a plurality of inner blades and a plurality of outer blades separated by an annular shroud that forms an extension of said air flow passage formed by said housing;

a second stator stage disposed in said outer duct downstream of said second axial flow impeller, wherein said second stator stage includes a plurality of inner vanes and a plurality of outer vanes separated by an annular shroud that forms an extension of said extended air flow passage formed by said annular shroud of said second axial flow impeller;

driving means for supplying motive force to said first axial flow impeller and second axial flow impeller; and heating means for heating the air flowing through said hair dryer.

20. An axial flow hair dryer as in claim 19, wherein said outer duct is rigidly connected to said main housing, said first stator stage is rigidly connected to said main housing and said second stator stage is rigidly connected to said outer duct, said drive shaft being mounted for rotation by said first and second stator stages.

21. An axial flow hair dryer comprising:

a housing forming an air flow passage having an air inlet and an air outlet;

a first axial flow impeller mounted on a drive shaft and disposed in said housing for generating air flow from said inlet to said outlet of said housing;

a first stator stage disposed in said housing downstream of said first axial flow impeller;

an outer duct forming an air flow passage having an air inlet and an air outlet, said outer duct being secured to said housing with said air outlet of said housing disposed to form an annular air intake between said housing and said outer duct;

a second axial flow impeller mounted on said drive shaft and disposed in said outer duct for generating air flow through said annular air intake to said outlet of said outer duct;

a second stator stage disposed in said outer duct downstream of said second axial flow impeller;

driving means for supplying motive force to said first axial flow impeller and second axial flow impeller; and heating means for heating the air flowing through said hair dryer, wherein said heating means comprises resistance wires mounted to vanes of said first stator stage.

22. An axial flow hair dryer comprising:

a housing forming an air flow passage having an air inlet and an air outlet;

a first axial flow impeller mounted on a drive shaft and disposed in said housing for generating air flow from said inlet to said outlet of said housing;

an outer duct forming an air flow passage having an air inlet and an air outlet, said outer duct being secured to said housing with said air outlet of said housing disposed to form an annular air intake between said housing and said outer duct;

a second axial flow impeller mounted on said drive shaft and disposed in said outer duct for generating air flow through said annular air intake to said outlet of said outer duct;

an electric motor connected to said drive shaft by a transmission mechanism for supplying motive force to said first axial flow impeller and second axial flow impeller, wherein said housing includes a handle depending therefrom and said motor is disposed in said handle;

a bracket connected to said handle and to said motor;

vibration-absorbing material interposed between said bracket and said motor; and heating means for heating the air flowing through said hair dryer.

23. An axial flow hair dryer comprising:

a housing forming an air flow passage between an air inlet for ambient air and an air outlet, said housing including a handle depending therefrom;

a first fan stage including a first axial flow impeller disposed in said housing for generating an ambient air flow into said air passage through said housing air inlet;

a first stator stage disposed in said housing downstream of said first fan stage and having a plurality of radially extending stator vanes connected to a central hub and rigidly secured to said housing;

an outer duct having an air inlet and an air outlet, said outer duct being rigidly secured to said housing with said housing air outlet disposed within said outer duct to introduce air flow exiting said housing air outlet into said outer duct and to form an air intake for ambient air between said housing and said outer duct;

a second fan stage including a second axial flow impeller disposed in said outer duct and including a plurality of blades disposed downstream of said housing air outlet for generating an ambient air flow into said outer duct through said air intake annularly of said air flow exiting said housing air outlet;

a second stator stage disposed in said outer duct downstream of said second fan stage and including a plurality of radially extending vanes;

a motor mounted inside said handle with a vibration-absorbing material interposed between said motor and said handle;

a drive shaft mounted for rotation in said hub of said first stator stage, said first fan stage and said second fan stage being mounted to said drive shaft for rotation therewith;

a flex shaft for supplying motive force from said motor to said drive shaft; and resistance heating means for heating air flowing through said air dryer and exiting said outer duct air outlet.

* * * * *